United States Patent [19]

Sorenson

[11] 4,210,791

[45] Jul. 1, 1980

[54] SLIDE SWITCH

[75] Inventor: Richard W. Sorenson, Avon, Conn.

[73] Assignee: Carlingswitch, Inc., West Hartford, Conn.

[21] Appl. No.: 973,147

[22] Filed: Dec. 26, 1978

[51] Int. Cl.[2] ..... H01H 9/02; H01H 15/02

[52] U.S. Cl. ..... 200/164 R; 200/16 D; 200/260; 200/295; 200/303

[58] Field of Search ..... 200/293, 295, 302, 16 R, 200/16 C, 16 D, 164 R, 16 F, 60, 252–261

[56] References Cited

U.S. PATENT DOCUMENTS

| | | | |
|---|---|---|---|
| 2,900,460 | 8/1959 | Wallace | 200/16 R X |
| 2,919,315 | 12/1959 | Woofter | 200/16 C |
| 3,156,804 | 11/1964 | Springer et al. | 200/60 X |
| 3,226,502 | 12/1965 | Schotz | 200/60 |
| 3,643,046 | 2/1972 | Zdanys, Jr. et al. | 200/76 |
| 3,843,852 | 10/1974 | Lockard | 200/16 D |
| 3,849,610 | 11/1974 | Lockard et al. | 200/16 R X |
| 3,857,000 | 12/1974 | Boulanger | 200/252 X |
| 3,983,341 | 9/1976 | Stanish | 200/303 X |
| 4,042,795 | 8/1977 | Sykora | 200/16 D |

*Primary Examiner*—Stephen Marcus

*Attorney, Agent, or Firm*—McCormick, Paulding & Huber

[57] ABSTRACT

A shielded contact slide switch is disclosed having two plastic dielectric parts, one of which parts houses the fixed electrical contacts, and the other of which parts moves relative to it and houses the bridging contact. Mating surfaces of the two parts are designed to seal off the contacts from environmental effects, and the actuator is defined on the movable part and has projecting portions to overlie a cavity or recess in the fixed part housing the fixed contacts regardless of switch position. The movable part also has projecting ears extending laterally into the side walls of the fixed part to restrict the sliding part to movement as dictated by the relative locations for the fixed and movable bridging contact. A spring return single pole double throw switch is disclosed but in place of the return spring another pole might be provided.

6 Claims, 5 Drawing Figures

SLIDE SWITCH

SUMMARY OF INVENTION

This invention relates generally to slide switches, and deals more particularly with a slide switch so designed as to require only two dielectric members or parts, one of which is movable with respect to the other and includes an actuator integrally formed therein.

The simplified slide switch of the present invention preferably includes a dielectric base member having laterally spaced side walls, integrally connected end walls extending between the side walls, and a rear wall cooperating with these walls to define a forwardly open recess. Fixed contacts are provided in the rear wall and are arranged in one or more rows as required to form a single or multi-pole switch. A dielectric slide member has a length greater than the longitudinal dimention of the recess in the base member in the direction of the row, or rows of contacts. Laterally projecting portions of the slide member are slidably received in elongated slots provided for this purpose in the base member, and more particularly in the side walls thereof. The slide member has an upstanding actuator portion for manual manipulation of the slide member relative to the base. Movement of the slide member may be limited by the length of the slots in the base side walls, relative to the size of the protecting portions of the slide member. The slide member also has a bridging contact member preferably designed to contact two of three contacts in the base depending upon the position of the slide member. The bridging contact is provided in a rearwardly open recess provided for this purpose in the slide member and another rearwardly open recess may be provided alongside of the bridging contact member recess, but with only one end wall so as to receive a return spring of the compression type arranged to act between the slide and the base. The projecting portions of the slide member may be relieved on their inner or rear side edges to facilitate assembly of the two dielectric components, and where the switch is intended for use in a panel or the like, projecting end portions on the base may cooperate with projecting flanges on the side walls of the base to engage the panel adjacent an opening having an appropriate size to so receive the switch.

DETAILED DESCRIPTION

Figure 1:
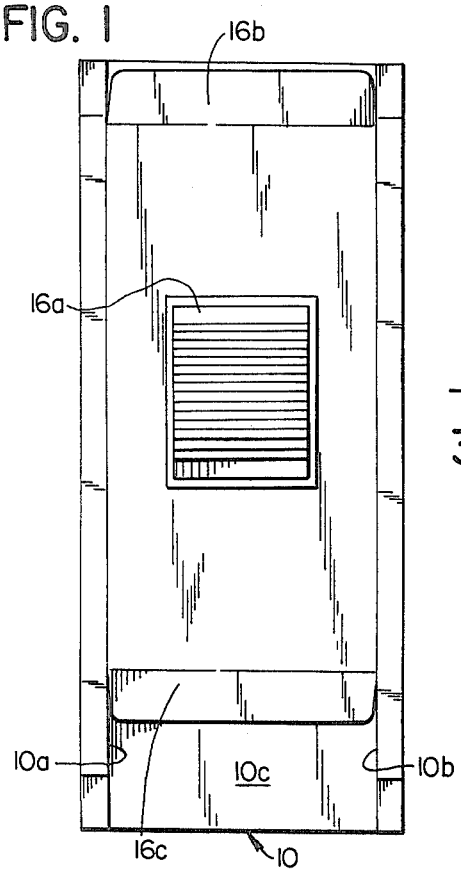
FIG. 1 is a plan view of a slide switch constructed in accordance with the present invention.

Turning now to the drawings in greater detail, FIG. 1 shows a simplified slide switch of the present invention including a base member 10 having an upper surface which defines a generally upwardly open channel with upstanding flanges 10*a* and 10*b* formed integrally with the top surface 10*c* of the base member.

Figure 3:
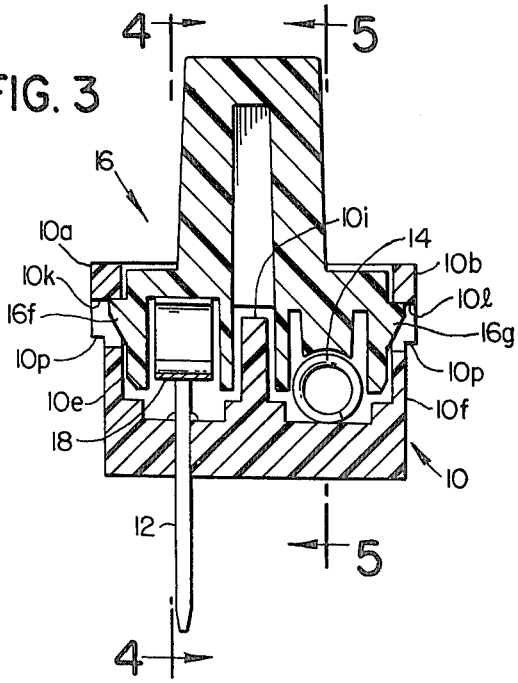
FIG. 3 is a sectional view taken generally on the line 3—3 of FIG. 2.

As best shown in FIG. 3, the base member 10 defines an upwardly or forwardly open recess, which recess is more particularly defined between longitudinally extending side walls 10*e* and 10*f*. This recess in the base member is further defined by end walls best shown in FIGS. 4 and 5 at 10*g* and 10*h*. These end walls are integrally connected to the rear wall and to the side wall of the base member and define the forwardly open recess referred to previously. As best shown in FIG. 3, the recess in the base member may have a central wall or divider 10*i* providing longitudinally extending side-by-side recess cavities. One such cavity preferably accommodates the contacts associated with a single pole double throw switch as indicated generally at 12 on the left-hand side of the FIG. 3 and the other recess or cavity may either include a second pole or row of contacts, (not shown) or as shown in FIG. 3 preferably houses a return spring 14 for urging the slide member 16 toward one end of the base member, as best shown in FIG. 5. The spring 14 in FIG. 5 acts between end wall 10*j* of base member 10 and against an abutment surface defined for this purpose on the slide member 16 to be described.

The slide member 16 has an upper portion 16*a* which may be conveniently grasped by the user for manipulating the switch, and this portion 16*a* is integrally connected to a generally rectangular portion best shown in FIG. 1 which is slidably received between the flanges 10*a* and 10*b* of the base member.

Figure 4:
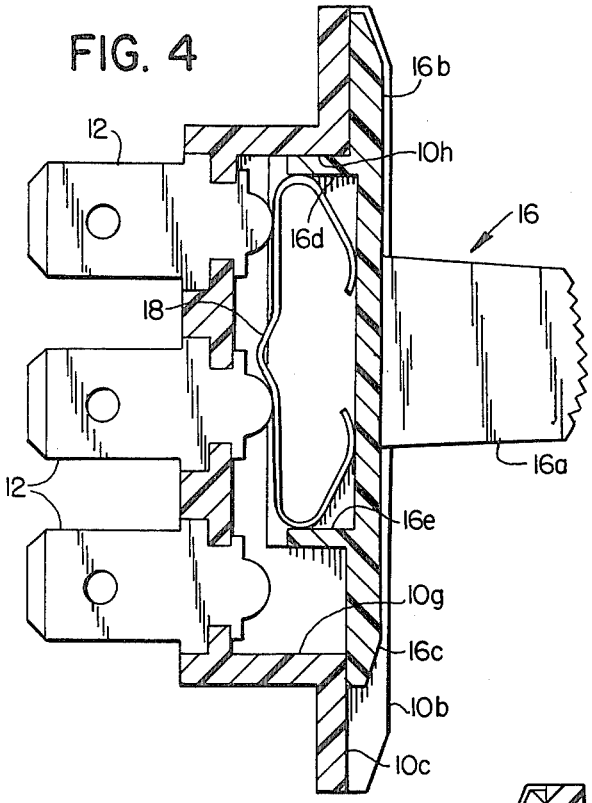
FIG. 4 is a sectional view taken generally on the line 4—4 of FIG. 3.
Figure 5:
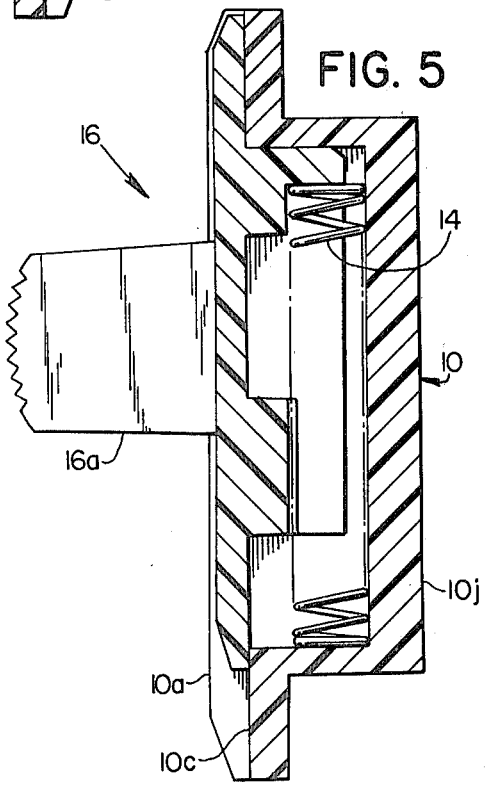
FIG. 5 is a sectional view taken generally on the line 5—5 of FIG. 3.

With particular reference to FIGS. 4 and 5, the slide member 16 has longitudinally extending end portions 16*b* and 16*c* which project longitudinally in overlying relationship with the base member 10 and which serve to close the front of the above described recess in the base member. The slide member 16 includes a rearwardly open recess for receiving a contact bridging member 18, and as best shown in FIG. 3 this bridging contact member recess is defined in cooperation with one of the two recesses provided in the base so that the contact bridging member 18 is adapted to electrically connect certain of the contacts defined on the inner ends of the conductive elements 12, 12 as best shown in FIGS. 3 and 4. The recess for said bridging contact member 18 includes end walls 16*d* and 16*e* which serve to locate the contact bridging member 18 so that said member moves with the dielectric slide 16 in making and breaking contact with the posts 12, 12 as best shown in FIG. 4.

Figure 2:
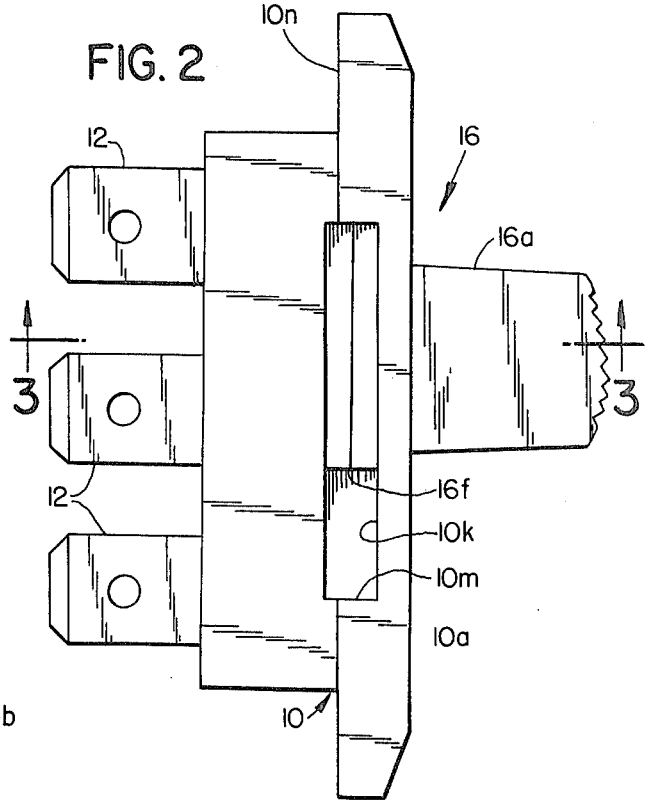
FIG. 2 is a side elevational view of the switch shown in FIG. 1.

Still with reference to FIG. 3, the slide member 16 also includes laterally outwardly projecting ear portions, 16*f* and 16*g*, which portions are slidably received in elongated slots 10*k* and 10 respectively. As best shown in FIG. 2 this configuration permits sliding movement of the member 16 between the position shown for it in that view and an alternative position wherein the contact bridging member 18 makes contact between the center and lowermost post, a limit position defined by abutment between the projecting portion 16*f* and the opposite end 10*m* of slot 10*k* as shown in FIG. 2.

As so constructed and arranged the base and slide members 10 and 16 respectively each have mating surfaces with longitudinally protecting ends which cooperate with one another so that the cavity or recess in which the contacts (both fixed and movable) are located is effectively sealed off from the environment where these switch is placed. That is, these overlying portions of the slide member, as described above with reference to 16*b* and 16*c*, will always overlie the forwardly open recess in the base member regardless of switch position.

The switch described above is adapted for convenient mounting in a panel opening or the like, and the underside of these projecting end portions for the base (10*n*) together with the slightly offset surfaces, indicated generally at 10*p* in FIG. 3, are adapted to abut the surface of such a panel in order to mount the switch in such a panel (not shown). The switch may be held in the panel opening by conventional means, that is either by fasteners, or by suitable integrally formed panel opening engaging wings or in accordance with other presently known means for accomplishing this panel mounting feature.

I claim:

1. A slide switch comprising a base member of dielectric material having laterally spaced side walls, integrally connected end walls extending between said side walls, and a rear wall cooperating with said side and end walls to define a forwardly open recess a plurality of fixed contacts having portions projecting forwardly through said rear wall and arranged in at least one row oriented longitudinally on said base member a slide member of dielectric material having a length greater than the longitudinal dimension of said recess in the direction of said row of contacts, and having laterally projecting portions slidably received in elongated slots defined in said base side walls to support said slide member for slidable movement relative to said base and to limit such movement so said base recess remains covered by said slide member a bridging contact in a rearwardly open recess provided in said slide member, and said dielectric members housing all of said contacts and defining a closed environment for said contacts consisting only of said dielectric slide and base members.

2. The slide switch defined in claim 1 wherein said two dielectric members have mating surfaces which include longitudinally projecting ends of both said slide member and said base member, and said base member including forwardly projecting flanges to define a shallow channel shaped recess for said projecting ends of said slide member.

3. The switch according to claim 2 wherein said dielectric slide member includes a longitudinally extending rearwardly projecting central wall defining two separated rearwardly open recesses, and at least one such recess having end walls for receiving said bridging contact therebetween, said end walls being spaced longitudinally from one another by a distance which is so related to the longitudinal extent of said recess in said base member that said slidable movement thereof is not restricted.

4. The switch according to claim 2 wherein said laterally projecting portions of said slide member have tapered rear faces to cooperate with the edges of said slots in said base and facilitate assembly of the two dielectric members by joining these members into assembled configuration, and said projecting portions having front faces conforming to the square edge of said slot to prevent inadverent disassembly thereof.

5. The switch according to claim 2 wherein said base member projecting ends have a rear surface for abutting a panel or the like in which said slide switch is adapted to be mounted, and a laterally projecting flange at the outside of said base side walls defining a rearwardly facing surface coextensive with said rear surfaces of said projecting base ends to facilitate mounting the switch in a panel or the like.

6. The switch according to claim 3 wherein said dielectric slide member includes one end wall for the other of said longitudinally extending recesses, and a compression spring acting between said one end wall and the opposite end of said recess in said base member to bias the slide member in one direction.

* * * * *